US005131701A

United States Patent [19]

Stepniewski

[11] Patent Number: 5,131,701

[45] Date of Patent: Jul. 21, 1992

[54] DOOR JAM DEVICE

[75] Inventor: Steven J. Stepniewski, White Bear Lake, Minn.

[73] Assignee: Sure-Lock Securities, Inc., White Bear Lake, Minn.

[21] Appl. No.: 751,980

[22] Filed: Aug. 29, 1991

[51] Int. Cl.[5] ..... E05C 19/18

[52] U.S. Cl. ..... 292/339; 254/39; 292/DIG. 46

[58] Field of Search ..... 292/342, 343, 338, 339, 292/DIG. 46; 254/39

[56] References Cited

U.S. PATENT DOCUMENTS

| | | | |
|---|---|---|---|
| 467,589 | 1/1892 | Finegan | 254/39 |
| 515,167 | 2/1894 | Provonsha | 254/39 |
| 4,019,765 | 4/1977 | Nichola | 292/338 |
| 4,070,049 | 1/1978 | Brewer | 292/338 X |
| 4,421,348 | 12/1983 | Kahn | 292/339 |
| 4,607,253 | 8/1986 | Wooten et al. | 292/339 X |
| 4,676,536 | 6/1987 | Arbic et al. | 292/339 |
| 4,792,168 | 12/1988 | Kardosh | 292/339 X |
| 4,883,297 | 11/1989 | Smith | 292/339 |

*Primary Examiner*—Richard E. Moore

*Attorney, Agent, or Firm*—Orrin M. Haugen; Thomas J. Nikolai; Charles G. Mersereau

[57] ABSTRACT

A door jam or guard for preventing forced entry through a door, the guard including an adjustable tubular brace having an upper tubular member and a lower tubular member telescopically engaged with the upper tubular member, a base pad mounted on the lower end of the tubular brace, a yoke mounted on the upper end of the tubular brace for engaging the door knob on the door, and a lever actuated extension in the upper tubular member for moving the yoke outwardly of the tubular member to seat the yoke against the handle.

8 Claims, 4 Drawing Sheets

DOOR JAM DEVICE

FIELD OF THE INVENTION

The present invention relates to a security guard to prevent forced entry of a door and more particularly to a door jam device which can be adjustably mounted between the door and the floor and wedged securely between the door knob and the floor.

BACKGROUND OF THE INVENTION

Security of an individual at home or while travelling has become a major concern due to the increasing incidence of breaking and entering. A number of devices have been developed which can be carried by the individual for personal security. Such devices have taken the form of portable door locks, alarm devices that react to the movement of the door and door braces mounted between the door and the floor to prevent entry.

The door brace is probably the most common because of its simplicity of operation and the personal satisfaction that when set it is virtually impossible to open the door. A typical example of a very early type of brace is shown in U.S. Pat. No. 3,583,743 to Newell which is in the form of a modified bumper jack. This type of brace includes a collar which fits under the door knob and a skidproof plate mounted on the bottom of the brace to prevent slippage on the floor. The brace is then jacked into position against the door. This brace utilizes a collar that engages the door knob and a pad pivotally mounted at the bottom of the brace.

A further feature of the invention is the ability to position the door jam device between the edge of a patio door and the door track to prevent opening of a patio door.

Most of these devices are used by senior citizens and women who often are not able to firmly wedge the brace in position. If not securely wedged in place, the door can be moved sufficiently to shake the pads loose and release the door.

SUMMARY OF THE PRESENT INVENTION

The present invention relates to a door jam device having an adjustable length shaft assembly that forms the main brace function. A nonskid pad is provided at both ends of the shaft assembly, the upper pad is U-shaped to encircle the door knob but also has a large nonskid surface that is in direct contact with the face plate to aid in preventing slippage. The lower pad is also provided with a large nonskid surface and is connected to the shaft assembly by a universal pivot that assures positive alignment with the surface of the floor. A simple and easily manipulated overcenter cam assembly is provided in the shaft for making a final adjustment in the length of the shaft assembly to provide positive contact of the pads with their respective surfaces.

The present invention advantageously provides an improved door jam device which is lightweight and can be quickly and easily collapsed for travel or storage.

A main feature of the invention relates to an overcenter cam assembly which can be easily manipulated to provide a final wedging action to positively wedge the device between the door and the floor.

A further feature of the invention relates to a lock mechanism for the foot of the door jam device that provides a positive connection to the door thus preventing release of the door jam.

Other principal features and advantages of the invention will become apparent to those skilled in the art upon review of the following drawings, the detailed description and the appended claims.

Figure 1:
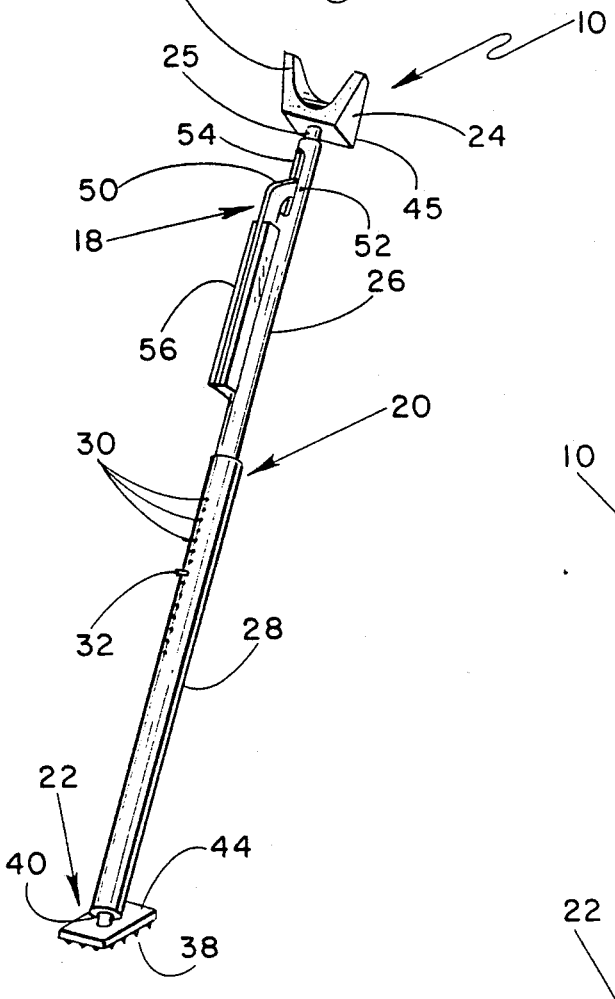
FIG. 1 is a perspective view of a portable door jam device according to the present invention.

Before explaining at least one embodiment of the invention in detail it is to be understood that the invention is not limited in its application to the details of construction and the arrangement of the components set forth in the following description or illustrated in the drawings. The invention is capable of other embodiments or being practiced or carried out in various ways. Also, it is to be understood that the phraseology and terminology employed herein is for the purposes of description and should not be regarded as limiting.

DETAILED DESCRIPTION OF THE PREFERRED EMBODIMENTS

Figure 2:
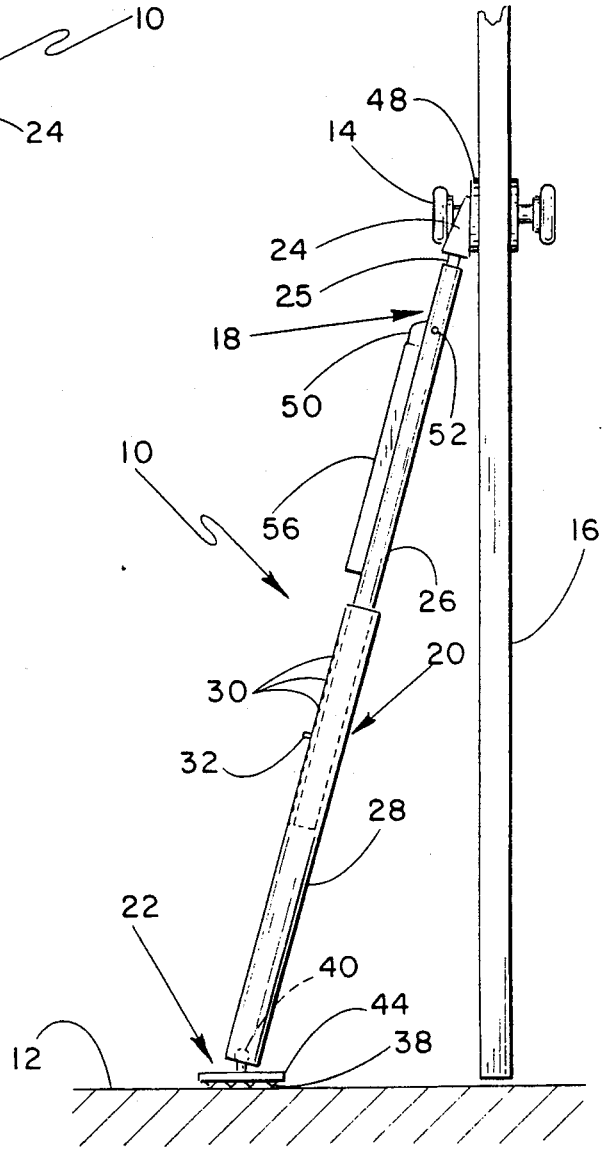
FIG. 2 is a side elevation view of the door jam device shown in the brace position.
Figure 3:
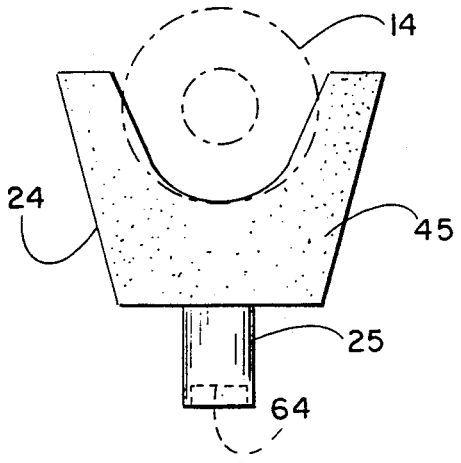
FIG. 3 is a view of the yoke shown in position to engage the door knob and plate.

The door jam device 10 according to the present invention, as shown in FIGS. 1 and 2, is wedged between the floor 12 and a door knob 14 provided on the door 16. The cam lock assembly 18 is advantageously provided in the device 10 to quickly and easily wedge the device 10 between the door knob 14 and floor 12. The device 10 generally includes a tubular assembly 20 having a base plate 22 at one end which rests on the floor 12 and a yoke 24 at the other end which is positioned to engage the door knob 14 and face plate 48. The tubular assembly 20 includes an upper tubular member 26 and a lower tubular member 28 which are telescopically engaged. The lower member 28 includes a plurality of holes 30 equally spaced at approximately one-half inch intervals along one side of the member 28.

An adjustment button 32 is provided in the upper tubular member 26 which is aligned with an aperture 34 in the lower end of the tubular member 26. The button 32 is biased outwardly through the aperture 34 by means of a spring 36. The tubular members are adjusted in length by pressing the button 32 inwardly and sliding the lower member 28 over the upper member 26 until the button 32 is aligned with one of the holes 30 in the lower member 28. With this arrangement the tubular members 26 and 28 can be adjusted to accommodate door knobs located at a wide variety of positions on the door.

The base plate 22 includes a nonskid compressible material 38 on the bottom for preventing sliding of the base plate on the floor 12. The base plate 22 is molded from a plastic material with a ball 40 provided on the top and a traction pad 44 at the bottom of the base plate. The ball 40 is seated in a corresponding recess 42 provided in the bottom of the lower tubular member 28. With this arrangement the base plate 22 is free to pivot in any direction within the limits of the recess 42, thus eliminating any possibility of misalignment of the pad with the floor.

The door jam device 10 is aligned with the door knob 14 by means of the yoke member 24 having a shaft 25 which is free to pivot in the upper end of the upper member 26 to thereby prevent any misalignment of the guard with the door knob. The yoke member 24 is formed from a plastic material with an anti-friction material 45 provided on the surfaces 46 so that a portion of the load on the door knob 14 is taken up by the engagement of the anti-friction material with the surface of the face plate 48 for the door knob.

Figure 4:
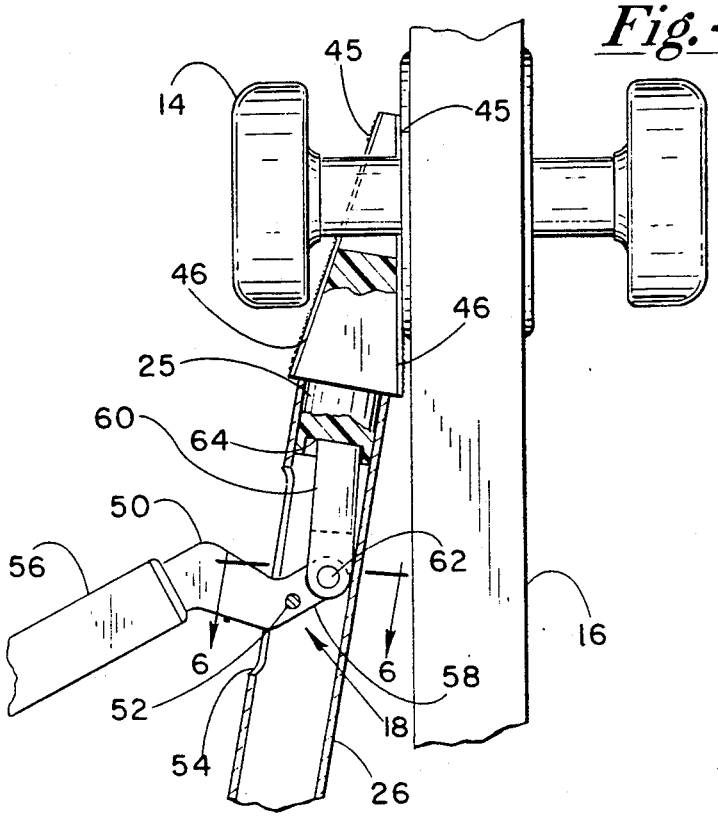
FIG. 4 is a cross-sectional view of the upper portion of the door jam device with the cam lock assembly in the open or release position.
Figure 6:
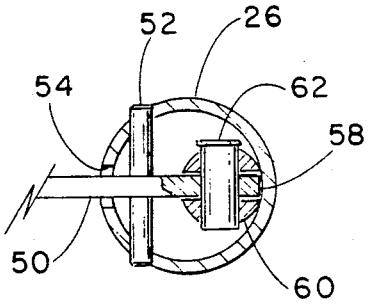
FIG. 6 is a view taken on line 6—6 of FIG. 4.
Figure 5:
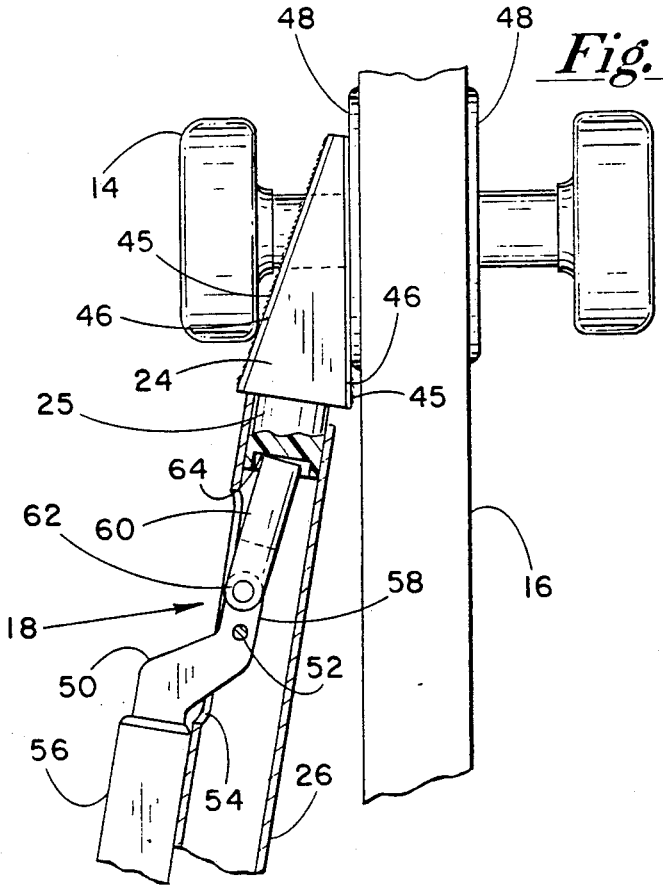
FIG. 5 is a view similar to FIG. 4 with the cam lock assembly in the set position.
Figure 7:
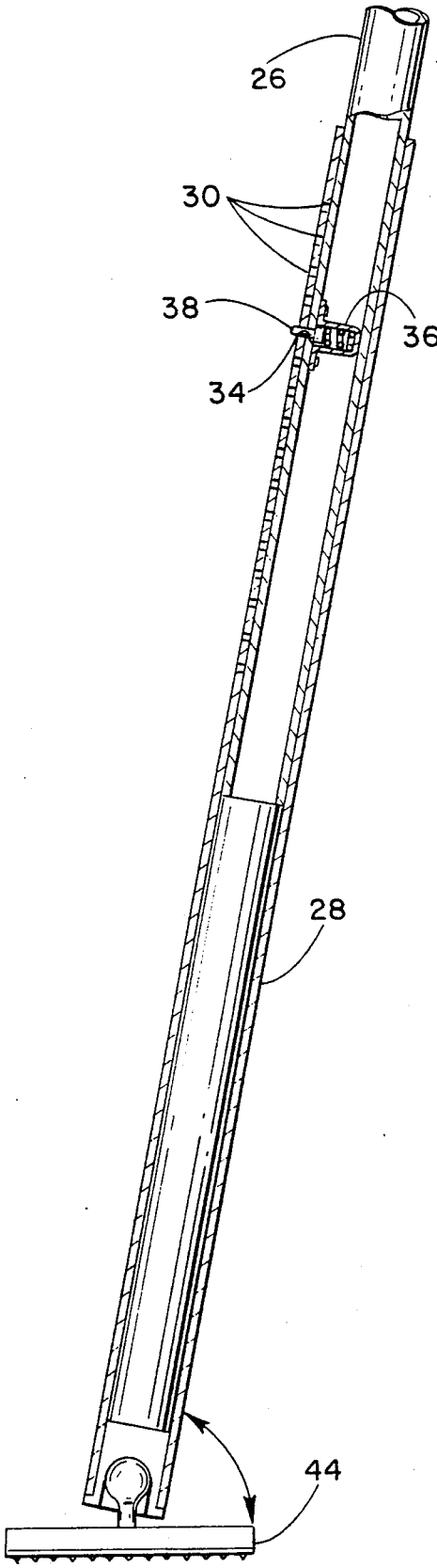
FIG. 7 is a cross-section view of the lower end of the door jam device.

The guard 10 is normally wedged between the door knob 14 and the floor 12 by forcing the base plate 22 toward the door to jam the yoke against the door knob 14. Since the base plate 22 and the yoke are provided with an anti-skid material it may be difficult to achieve a tight fit because of the force required to move the base plate with respect to the floor. To assure a positive wedging fit between the floor and the door knob a cam lock assembly 18, shown in FIGS. 4, 5 and 6, is provided to extend the length of the guard approximately one-quarter inch to one-half inch after the guard has been firmly wedged in position.

This is achieved by the cam lock assembly 18 which generally includes a lever 50 that extends through a slot 54 in the member 26 and is pivotally mounted on a pin 52 in the upper member 26. The lever 50 includes a handle portion 56 and an extension 58. An actuator pin 60 is pivotally mounted on the end of extension 58 by means of a pin 62. The actuator pin 60 is seated in a recess 64 provided in the shaft 25 of the yoke 24. It should be noted that the pin 62 moves over center to pin 52 when the lever is pivoted to the locked position. With this arrangement the wedging force introduced into the yoke will also act on the lever to seat the handle against the side of the upper tube 26.

Figure 8:
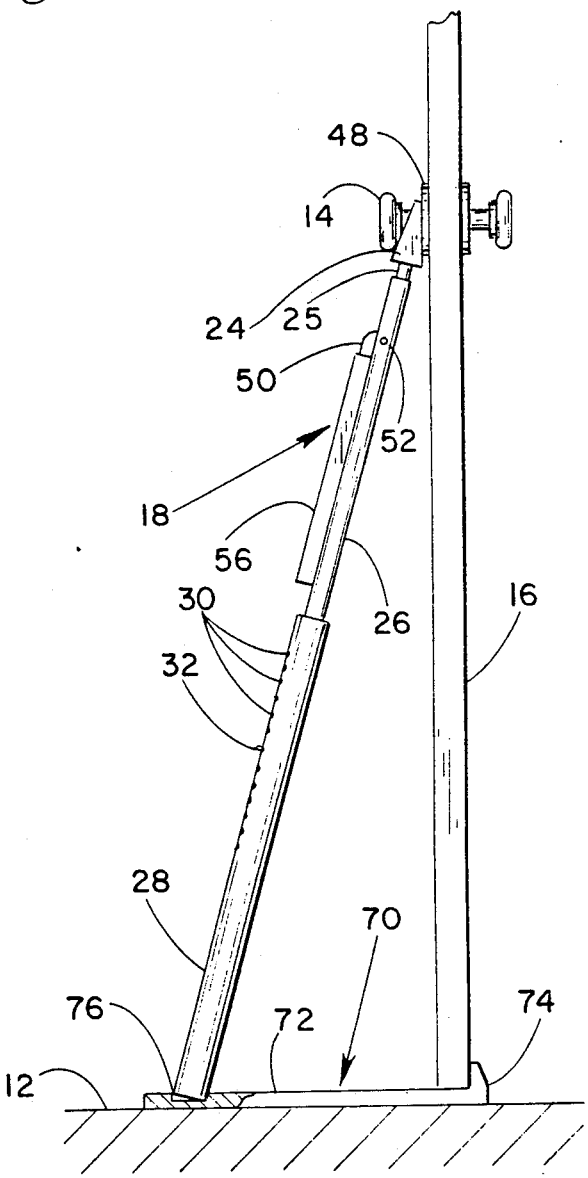
FIG. 8 is a side elevation view of the door jam device with a lock mechanism for securing the foot of the device to the door.
Figure 9:
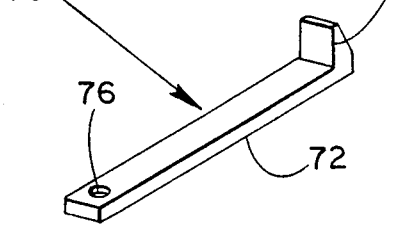
FIG. 9 is a perspective view of the lock mechanism shown in FIG. 8.
Figure 10:
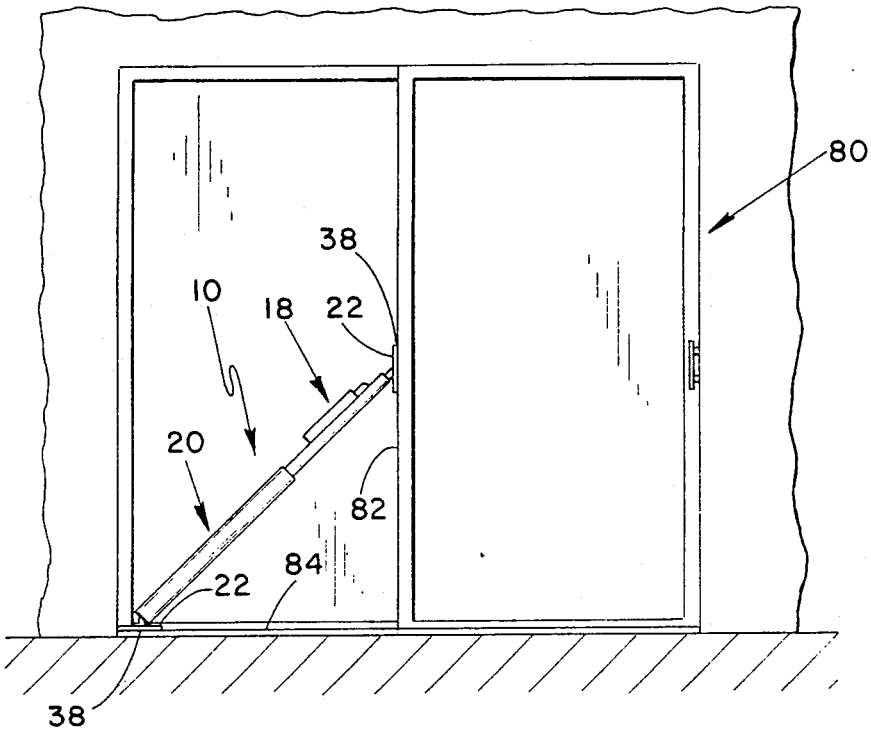
FIG. 10 is a view of a sliding type patio door with the door jam device located between the door and the horizontal track.
Figure 11:
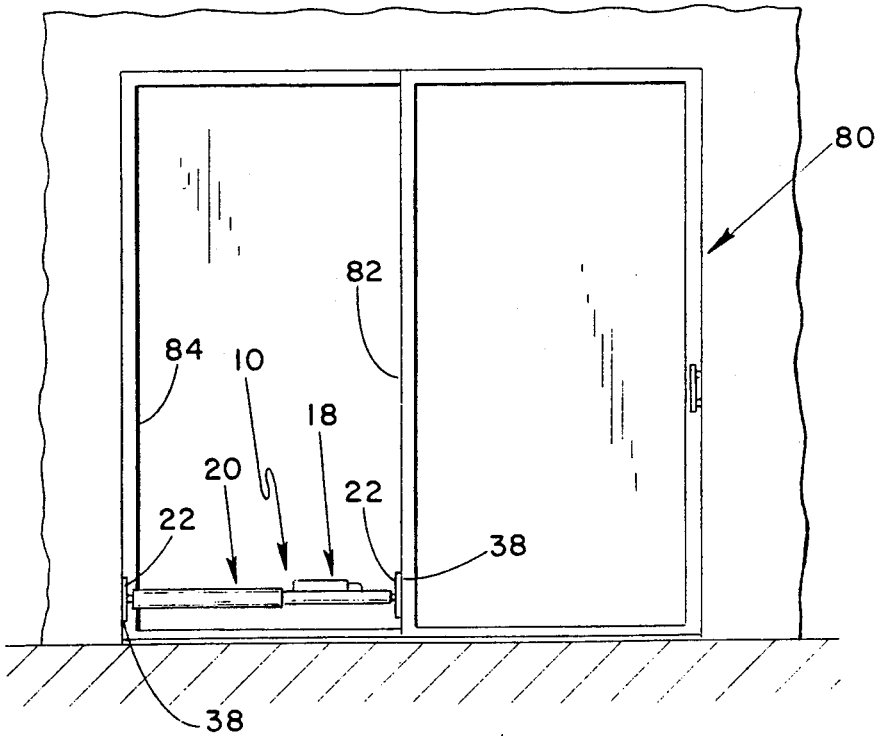
FIG. 11 is a view of the door jam device located between the door and the vertical track.

Referring to FIGS. 8 and 9, means are shown for securing the lower end tubular member 28 to the door 16. Such means is in the form of a lock mechanism 70 which is formed from a thin metal strip 72 having a block 74 at one end and a hole 76 at the other end. The metal strip 72 is put under the door 16 with the block 74 on the outside of the bottom of the door to prevent the strip from sliding under the door. On the inside of the door, the lower end of the tubular member 28 or base plate 22 may be inserted into the hole 76. When the door jammer is tightened up between the door knob 14 and the floor 12, the tubular member 28 is seated securely in the hole 76. The lock mechanism 70 prevents anyone from inserting a piece of metal or a yardstick under the door to dislodge the traction pad 44 from under the door.

Although the door jam device 10 has been shown and described with respect to a hinged type door, it can also be used to secure a sliding type patio door 80. In this regard, the yoke 24 can be replaced by a base plate 22 having a nonskid pad 38 of the type described herein. The door jam device 10 can then be aligned with the edge 82 of the patio door 80 with the lower base member 22 and pad 38 seated in the sliding door track 84 and the upper base member 22 and pad 38 seated against the edge 82 of the sliding door 80. The door jam device 10 can then be wedged between the edge 82 of the door 80 and the door track 84 by means of the cam lock assembly 18 as described above.

Thus, it should be apparent that there has been provided in accordance with the present invention a door jam device that fully satisfies the aims and advantages set forth above. Although the invention has been described in conjunction with specific embodiments thereof, it is evident that many alternatives, modifications and variations will be apparent to those skilled in the art. Accordingly, it is intended to embrace all such alternatives, modifications and variations that fall within the spirit and broad scope of the appended claims.

The embodiments of the invention in which an exclusive property or privilege is claimed are defined as follows:

1. A door guard for preventing a door from opening, said guard comprising an adjustable tubular brace having an upper tubular member and a lower tubular member telescopically engaged with said upper tubular member, a base pad mounted on one end of the lower member for engaging the floor, a yoke mounted on the upper end of said tubular brace for engaging the door knob on the door and means mounted in the tubular member for manually extending the length of the guard after the guard has been wedged in position between the door and the floor wherein said extending means includes a lever pivotally mounted on said upper tubular member, said lever including a handle and an extension projecting into said tubular member, an actuator pin pivotally mounted on the end of said extension, said pin being positioned to engage said yoke whereby said extension will move said pin on said yoke outwardly of said tubular member on pivotal movement of said lever.

2. The guard according to claim 1 including a lock mechanism having a block on one end to engage the outside of the door and a hole in the other end for engaging the lower end of the guard.

3. A guard for preventing forced entry of a door, said guard comprising:

a base plate, a brace assembly having a first member telescopically received in a second member, means for pivotally connecting said brace assembly to said base plate, an upper yoke member telescopically received in said brace assembly, and means in said brace assembly for moving said yoke axially in said brace assembly to firmly seat the door guard between the floor and the door, said moving means comprises a handle pivotally mounted in said brace assembly, a pin positioned in said brace member and being pivotally connected to said handle, said pin being operatively connected to said yoke whereby pivotal movement of said handle will move said pin and yoke axially into engagement with said door knob.

4. The guard according to claim 3 including means for securing said base plate to the bottom of the door.

5. A door jam device for preventing forced opening of an entry door, said door jam device including a tubular lower member and a tubular upper member telescopically aligned with said lower member, a plurality of holes in one side of said lower member and a pin mounted in said upper member for selectively engaging one of said plurality of holes in said lower member, a yoke member mounted on the upper end of said upper member for pivotable and axial movement with respect to the upper member, said yoke member having an upper generally U-shaped portion for fitting beneath and partially around a door knob on the entry door, and a handle pivotally mounted in said upper member and operatively positioned to move said yoke member into abutting engagement with said door knob and the lower member into engagement with the floor whereby said door jam device is wedged between the floor and the door knob.

6. The device according to claim 5 including means for securing said lower member to the bottom of the door.

7. The device according to claim 6 wherein said securing means comprises a metal strip having a block on one end positioned to engage the outside of the bottom of the door and a hole in the other end for engaging the lower end of the lower member.

8. A door guard for preventing a sliding door from moving in the sliding door track opening, said guard comprising a lower member and an upper member telescopically aligned with said lower member, a plurality of holes in one side of one of said members, a pin in the other of said members for selectively engaging one of said plurality of holes in the other member, a base plate mounted at the upper end of said upper member and at the lower end of said lower member, and a cam lock assembly mounted in one of said members and to move one of said base plates into engagement with the edge of said door and the other of said base plates into engagement with the door track whereby the door guard is wedged between the track and the edge of the door.

* * * * *